United States Patent [19]

Focke et al.

[11] Patent Number: 4,776,461

[45] Date of Patent: Oct. 11, 1988

[54] PACK FOR CIGARETTES OR THE LIKE

[75] Inventors: Heinz Focke; Kurt Liedtke, both of Verden, Fed. Rep. of Germany

[73] Assignee: Focke & Co. (GmbH & Co.), Verden, Fed. Rep. of Germany

[21] Appl. No.: 903,793

[22] Filed: Sep. 4, 1986

[30] Foreign Application Priority Data

Sep. 4, 1985 [DE] Fed. Rep. of Germany ..... 3531566

[51] Int. Cl.[4] ..... B65D 85/10

[52] U.S. Cl. ..... 206/271; 206/274; 229/132

[58] Field of Search ..... 206/271, 273, 274; 229/87 C, 5.5, 132, 136, 137, 138

[56] References Cited

U.S. PATENT DOCUMENTS

| | | | |
|---|---|---|---|
| 1,702,325 | 2/1929 | Van Sickels | 206/274 |
| 1,907,067 | 5/1933 | Hartmann | 206/273 |
| 2,373,524 | 4/1945 | Vollmer | 206/273 |
| 2,874,891 | 2/1959 | Kelsall | 229/136 |
| 3,120,334 | 2/1964 | Schill | 229/137 |
| 3,237,843 | 3/1966 | Reed et al. | 229/87 C |
| 3,265,287 | 8/1966 | Houland | 206/274 |
| 3,301,468 | 1/1967 | Staley | 229/87 C |
| 3,333,683 | 8/1967 | Scharre | 229/87 C |
| 3,438,566 | 4/1969 | Mahon | 229/137 |
| 3,952,868 | 4/1976 | Muller et al. | 206/274 |
| 4,003,467 | 1/1977 | Focke et al. | 206/274 |
| 4,180,201 | 12/1979 | Focke | 229/132 |
| 4,250,994 | 2/1981 | Focke | 229/48 T |
| 4,303,155 | 12/1981 | Focke et al. | 206/273 |

FOREIGN PATENT DOCUMENTS

| | | | |
|---|---|---|---|
| 2352718 | 4/1975 | Fed. Rep. of Germany | 206/274 |
| 2854443 | 3/1980 | Fed. Rep. of Germany . | |
| 207946 | 10/1966 | Switzerland | 229/132 |
| 926469 | 5/1963 | United Kingdom | 229/136 |
| 1053776 | 2/1965 | United Kingdom . | |
| 1056034 | 1/1967 | United Kingdom | 229/132 |

*Primary Examiner*—David T. Fidei

*Attorney, Agent, or Firm*—Sughrue, Mion, Zinn, Macpeak, and Seas

[57] ABSTRACT

In (cigarette) packs, sealing and consequently aroma and moisture preservation are unsatisfactory, particularly because of a lack of sealing of an inner wrapping (tin foil blank 13). With the external appearance and constructive design of a (soft-cup) pack being maintained, the inner wrapping is sealed off by means of bonding strips in specific regions of the overlap or fold. Of particular importance here is a bonding strip (23) in the region of a continuous longitudinal overlap 20 which ensures a considerable increase in leak-proofing.

5 Claims, 4 Drawing Sheets

Fig. 2
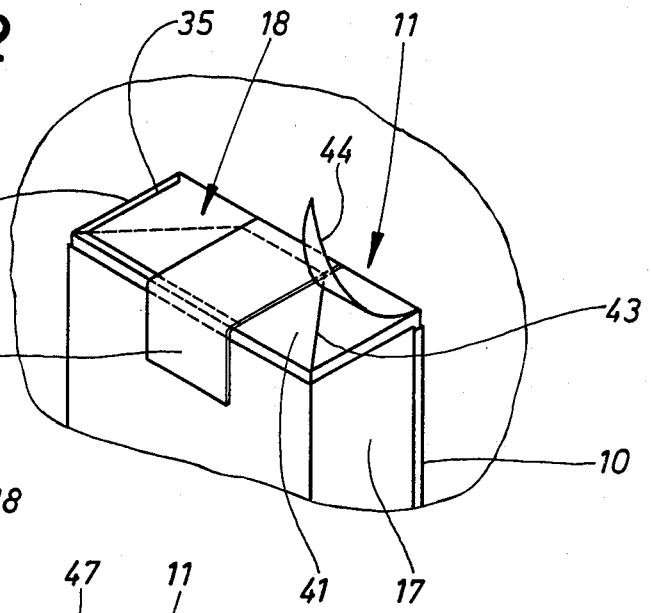
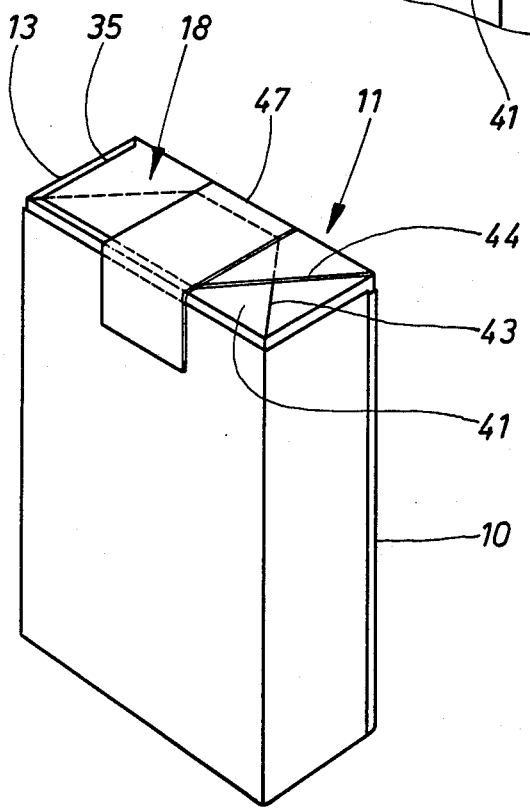
Fig. 1

PACK FOR CIGARETTES OR THE LIKE

BACKGROUND OF THE INVENTION

The invention relates to a cuboid pack for cigarettes or the like, with an inner wrapping, especially made of tin foil, which receives the pack contents, and with an outer wrapping made of paper, cardboard or the like, especially a soft-cup pack, the inner wrapping surrounding the pack content to constitute a longitudinal overlap extending in the longitudinal direction, and forming an (upper) end wall composed of end tabs partially covering one another.

The most common types of cigarette pack are constructed so that the pack contents, in particular a cigarette group, surrounded by an inner wrapping are accommodated in the actual pack. This pack can be a hinge-lid pack made of thin cardboard or a soft cup pack made of paper. An outer wrapping consisting of cellulose or polyethylene film is intended to ensure additional sealing of the pack contents against aroma and moisture losses. However, since none of these wrappings guarantee leak-proofing because of their construction, the aroma preservation of these conventional cigarette packs is unsatisfactory.

SUMMARY OF THE INVENTION

The object on which the invention is based is to develop further and improve a pack of the type mentioned in the introduction, so that, whilst the conventional design of the pack is largely maintained, a higher degree of preservation of the pack contents against aroma and moisture losses is guaranteed.

To achieve this object, the pack according to the invention is characterized in that the longitudinal overlap of the inner wrapping is made leak-proof by means of adhesive bonding or welding.

The invention is preferably used with the "soft-cup" type of pack. The cigarette group is surrounded by a conventional inner wrapping, especially made of tin foil. This is folded so that at least one longitudinal overlap extending in the longitudinal direction of the cigarettes is obtained and there are folds at least in the region of one end wall. Preferably, the inner wrapping (tin foil blank) is folded in such a way that the longitudinal overlap extends in the region of a front wall and, in addition to the end wall, a bottom wall is also formed from bottom tabs.

According to the teaching of the invention, selected regions of the overlaps and fold of the inner wrapping are sealed off by means of adhesive bonding or welding. In the simplest version, a considerable increase in leak-proofing is achieved merely by means of a (continuous) adhesive bonding of the longitudinal overlap.

Further developments of the invention relate to a modified design or folding of bottom tabs to form the bottom wall, in such a way that an outer bottom-covering tab, which essentially covers the surface of the bottom wall, is bonded or welded to the remaining bottom tabs along bonding strips located at the edges. As a result, increased leak-proofing in comparison with conventional designs of the inner wrapping is obtained (even) in the region of the bottom wall.

According to a further proposal of the invention, the end wall is also reshaped in terms of the design of the end tabs, in such a way that a part region of the end wall is sealed off by bonding strips of an outer end covering tab. Only a region serving for opening the inner wrapping, conventionally located next to a revenue or closing stamp extending transversely over the end wall, is designed in a customary way, that is to say with trapezoidal longitudinal end tabs which are not bonded to one another and which therefore allow the inner wrapping to be torn open or opened in this region in the usual way.

Further features of the invention relate to the design of the end wall and bottom wall and to blanks for inner wrappings of this type.

BRIEF DESCRIPTION OF THE DRAWINGS

Exemplary embodiments of the invention are explained in detail below with reference to the drawings. In the drawings:

FIG. 1 shows a perspective view of a (soft-cup) pack for cigarettes,

FIG. 2 shows the upper end-wall region of the pack according to FIG. 1 during the opening of the latter.

DESCRIPTION OF THE PREFERRED EMBODIMENTS

Figure 5:
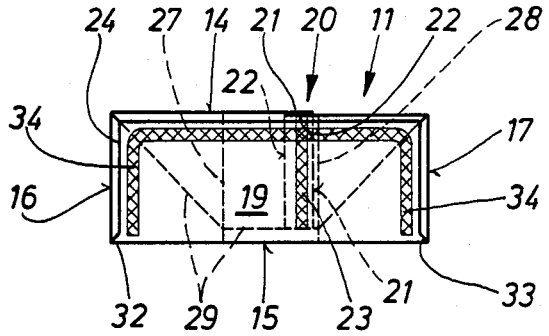
FIG. 5 shows a bottom view of the tin foil block according to FIGS. 3 and 4.
Figure 4:
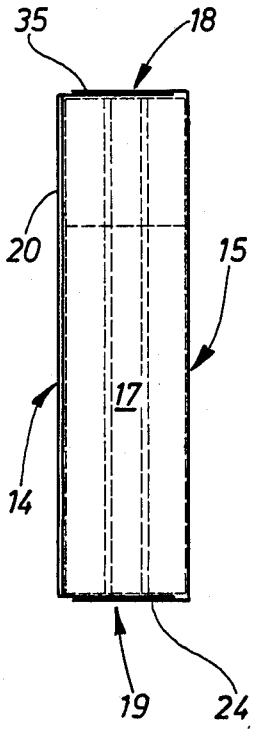
FIG. 4 shows a side view of the tin foil block according to FIG. 3.
Figure 3:
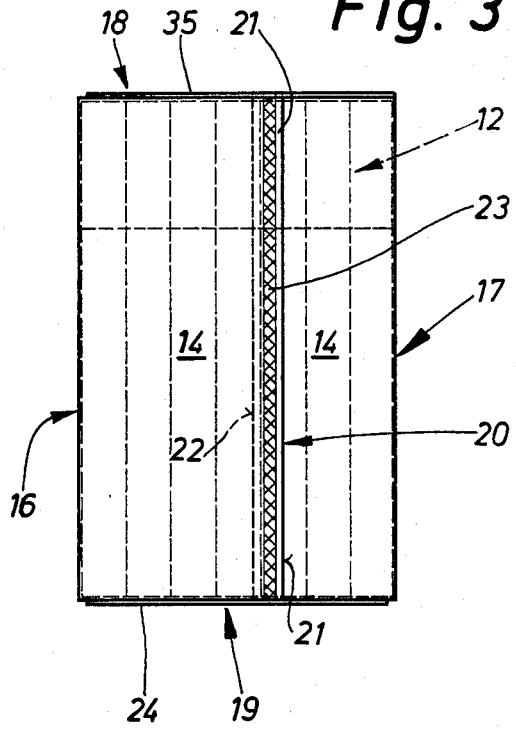
FIG. 3 shows a front view of a cigarette group with an inner wrapping (tin foil block)

In the drawings, a cigarette pack is shown as a preferred exemplary embodiment or practical example, specifically, according to FIGS. 1 and 2, a soft-cup pack. This consists of a soft cup 10 made of paper or the like which is open at the top. The soft cup 10 is formed, especially folded, in the customary way. A cigarette block, in particular a tin foil block 11, is accommodated in this actual pack. The dimensions are selected so that the tin foil block 11 projects slightly from the soft cup 10. The tin foil block 11 is formed from a cigarette group 12 as the pack contents and an inner wrapping surrounding them, in particular a tin foil blank 13. The latter consists in the usual way of a preferably inner paper layer and an aluminium layer.

The tin foil block 11 is cuboid, with a front wall 14, a rear wall 15, side walls 16 and 17, and an upper end wall 18 and a lower bottom wall 19.

The inner wrapping, that is to say the tin foil blank 13, surrounds the cigarette group 12, in such a way that a longitudinal overlap 20 extending over the entire length of the tin foil blank 13 is obtained in the region of the front wall 14 or rear wall 15, in the present case in the region of the front wall 14. The end wall 18 and bottom wall 19 are formed by end tabs and bottom tabs which likewise partially cover one another and which are yet to be described in detail.

In the present tin foil block 11, the longitudinal overlap 20 is hermetically sealed, specifically by means of a bonding strip 23 connecting to one another edge strips 21 and 22 of the tin foil blank 13 which are provided in the region of the overlap. This bonding strip 23 consists of a suitable material, for example a glue strip provided directly during the production of the inner wrapping, or an activatable hot-melt adhesive strip already previously coated on a sheet of material for producing the tin foil blanks 13. After folding has been carried out, the hotmelt glue is activated by means of pressure and heat, thus resulting in the sealed bonding of the edge strips 21 and 22. The longitudinal overlap 20 formed in this way also extends into the region of the end wall 18 and bottom wall 19.

During the production of the inner wrapping with a hermetically sealed longitudinal overlap 20, the edge strips 21 and 22 are connected to one another while they are in a tubular intermediate folding position. The end wall 18 and bottom wall 19 can then be formed in the usual way by folding in end tabs and bottom tabs, without these being connected to one another.

A further increase in the leak-proofing of the inner wrapping can be achieved if (additionally) the bottom wall 19 is made (relatively) leak-proof. For this purpose, a special fold is provided here. As can be seen particularly in FIGS. 7 and 8, a bottom covering tab 24 adjoining the area of the rear wall 15 is divided off from the adjacent cuts regions of the bottom tabs by means of lateral severing 25 and 26. It is thereby possible to fold in such a way that bottom side tabs 27 and 28 are first folded onto the pack content and then a longitudinal bottom tab 29 is folded onto the pack content or onto the bottom side tabs 27, 28. The longitudinal bottom tab 29 assumes a trapezoidal shape, specifically because triangular folding gussets 30 and 31 are folded in or between the bottom side tabs 27 and 28, on the one hand, and the longitudinal bottom tab 29 on the other hand.

As an outer covering, the rectangular bottom covering tab 24 is folded onto the above-described bottom tabs and covers virtually the entire surface of the bottom wall 19. As a result of an appropriate arrangement and size of the lateral severing cuts 25 and 26, the bottom covering tab 24 has a smaller length and smaller width than the surface of the bottom wall 19. Corner seals 32 and 33 are thus obtained at the corners facing the rear wall 15.

The bottom covering tab 24 is connected in a leak-proof manner to the remaining bottom tabs by means of adhesive bonding or welding. In the exemplary embodiment illustrated, there is attached to the inner face (paper layer) a U-shaped bonding strip 34 which extends along the free edges of the bottom covering tab 24 and which ensures a substantially leak-proof closure of the bottom wall 19 as a result of adhesive bonding or welding to the longitudinal bottom tab 29 and the bottom side tabs 27 and 28.

In this exemplary embodiment (FIG. 7), the end wall 18 can be folded in the conventional way in the form of two trapezoidal longitudinal tabs partially covering one another.

Figure 8:
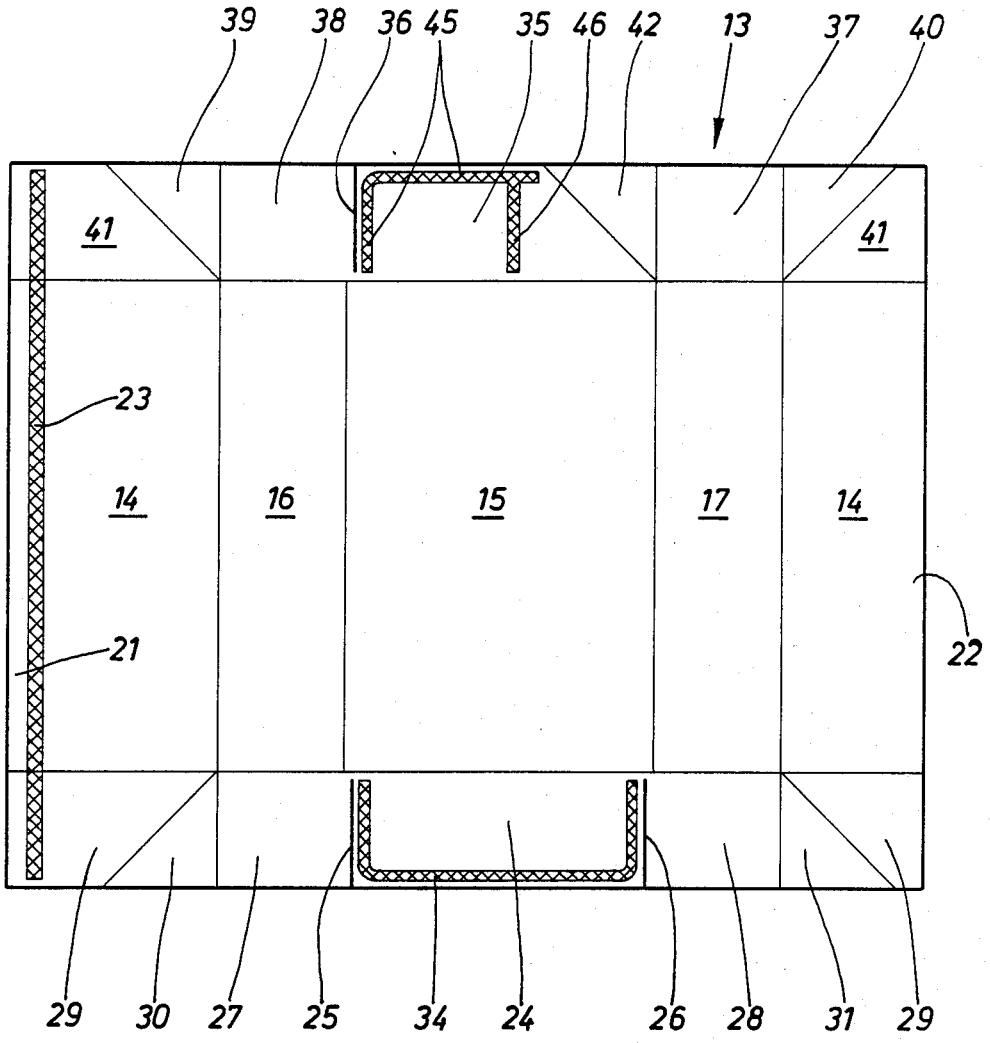
FIG. 8 shows a (tin foil) blank for an inner wrapping according to FIGS. 2 to 6.

Alternatively, according to a further development, the end wall 18 can also be designed with increased leak-proofing. For this purpose an end covering tab 35 likewise adjoining the rear wall 15 is divided off on one side from adjacent end tabs by means of a lateral severing cut 36 (FIG. 8). Consequently, this region is of rectangular shape and results in a covering of a part region of the end wall 18. The opposite region of the end covering tab 35 remains connected to an adjacent end side tab 37. When this end side tab 37 and the second opposite end side tab 38 are folded in, triangular folding gussets 39 and 40 are obtained as a connection to an inner trapezoidal longitudinal end tab 41. Because of the lack of a severing cut, the outer end covering tab 35 is connected to the associated end side tab 37 via a triangular folding gusset 42 likewise folded inwards, so that, on this side, both the longitudinal end tab 41 and the end covering tab 35 form oblique folding edges 43 and 44. These are intended to make it possible to open the inner wrapping (tin foil blank 13) when the cigarette pack is used, the folding edge 44 being grasped in the usual way and a portion of the end tabs being detached from the tin foil blank 13 in this region.

Figure 6:
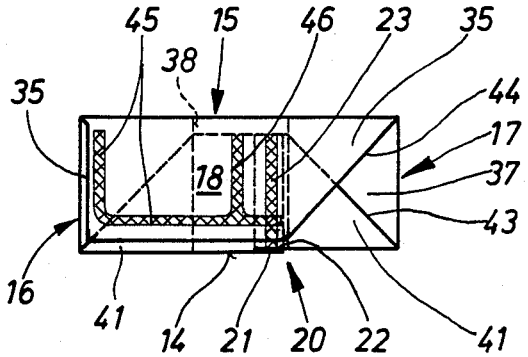
FIG. 6 shows a plan view of the tin foil block according to FIGS. 3 and 4.

The region of the end covering tab 35 outside the folding edge 44 is connected to the end-tab regions located underneath it by means of adhesive bonding or welding. For this purpose, an L-shaped bonding strip 45 is arranged along the free edge of the rectangular part of the end covering tab 35, with a transversely directed leg 46 (FIGS. 6 and 8). Substantial sealing of the end wall 18 is thereby achieved even in this region, without the handling of the cigarette pack or its external appearance being impaired or altered. The size of the leg 46 of the bonding strip is such that the end covering tab 35 is connected in this region to the longitudinal end tab 41 located underneath.

A conventional closing strip or revenue stamp 47 (FIGS. 1 and 2) is laid transversely over the end wall 18 of the tin foil block 11 in the usual way and extends into the region of the front wall and rear wall of the soft cup 10. This revenue stamp 47 covers the middle region of the end tabs or end wall, but, even in the exemplary embodiment of FIGS. 6 and 8, leaves free the non-bonded part of the end covering tab 35 and of the longitudinal end tab 41 (with the oblique folding edges 43 and 44). As a result, this version of the inner wrapping or pack can also be opened in the customary way, that is to say by grasping the upper oblique folding edge 44 of the end covering tab 35 and tearing off the latter along a side edge of the revenue stamp 47 (FIG. 2).

Figure 7:
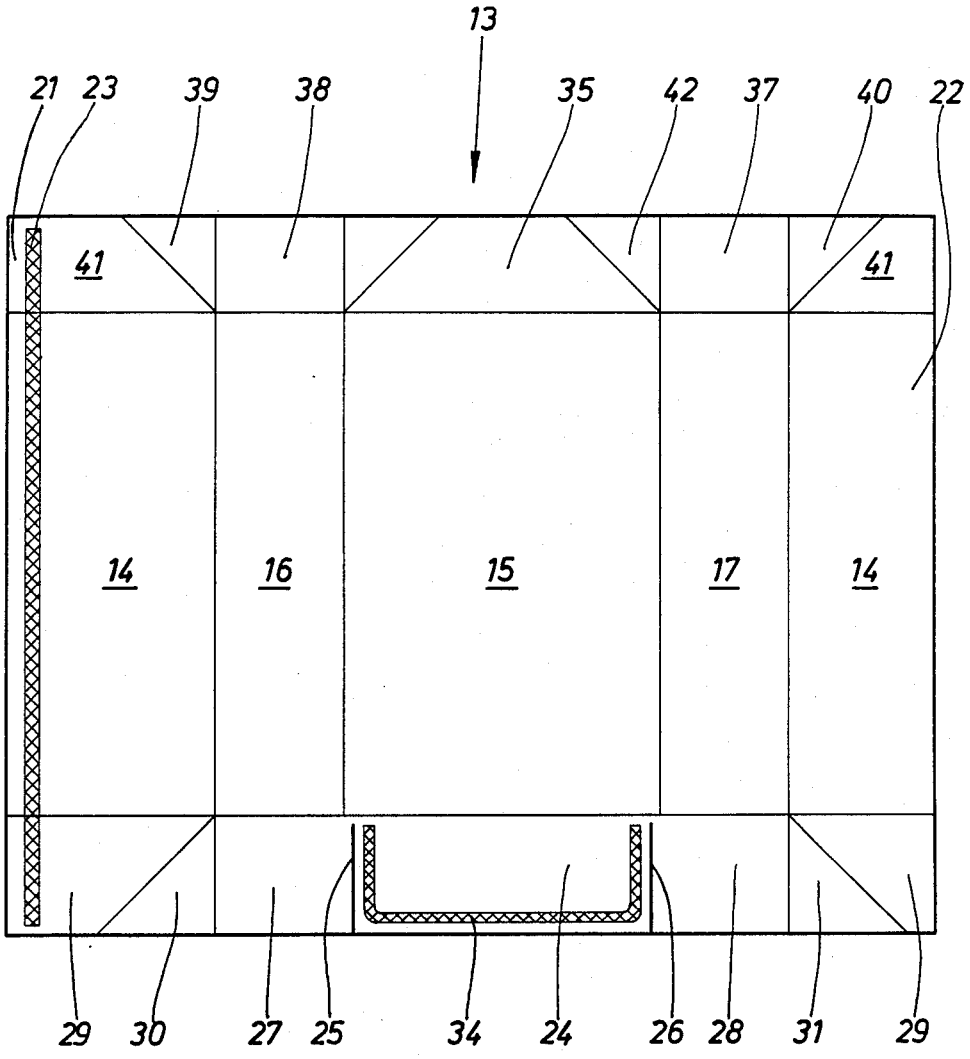
FIG. 7 shows a (tin foil) blank for an inner wrapping according to FIGS. 3, 4 and 5.

As can be seen, for example, in FIGS. 7 and 8, all the bonding strips can be attached to the spread-out blank by being pressed on, especially where hot-melt strips are concerned. Expediently, as regards tin foil blanks, the bonding strips are only attached on the side of the paper layer.

What is claimed is:

1. Cuboid soft-cup pack for cigarettes or the like, with an inner wrapping formed from a tin-foil blank surrounding the pack contents of the package, and with an outer wrapping of paper, cardboard or the like, characterized in that:

the tin-foil blank (13) is folded in such a manner around the pack contents that a longitudinal overlap (20), consisting of edge strips (21, 22) of the tin-foil blank (13), is formed in a region of a front wall (14) of the pack;

an upper end pack wall (18) and a lower bottom pack wall (19) are respectively formed by upper end tabs and bottom tabs partially covering one another;

the longitudinal overlap (20) extends over the entire length of the tin-foil blank (13) into a region of the end wall (18) and bottom wall (19);

the edge strips (21, 22) are adhesively bonded together so that the longitudinal overlap (20) has an air-tight construction over its entire length, including the front end wall and the bottom wall;

the bottom wall (19) is formed from bottom side tabs (27, 28) folded against the pack contents, trapezoidal longitudinal bottom tabs (29) folded against said bottom side tabs, and an outer, bottom-covering, rectangular tab (24) essentially covering the surface of the bottom wall (19), the bottom-covering tab (24) being divided off from adjacent bottom tabs by bottom lateral severing cuts (25, 26) and being bonded along its free edges to the adjacent bottom tabs by a U-shaped bonding strip (34);

the upper wall (18) is formed from: upper side tabs (37, 38) folded against the pack contents; trapezoidal longitudinal upper end tabs (41) folded against said upper side tabs (37, 38) and said contents, said longitudinal overlap (20) extending into the area of one of said longitudinal upper end tabs (41); and an outer end covering tab (35), folded against said longitudinal upper end tabs (41) and divided off from an adjacent end side tab (38) by an upper lateral severing cut (36) forming a rectangular side of said end covering tab (35), said end covering tab (35) being connected along its free edges to said one longitudinal upper end tab (41) and said adjacent end side tab (38) by an L-shaped bonding strip (45).

2. Pack according to claim 1, characterized in that, because of the distance between the bottom lateral severing cuts (25, 26) and their length, the bottom covering tab (24) has smaller width and length dimensions than the surface of the bottom wall (19).

3. Pack according to claim 1, characterized in that the longitudinal overlap (20) in the region of the upper end wall (18) extends underneath a centrally-arranged tax revenue stamp (47) extending transversely over the upper end wall (18).

4. Pack according to claim 3, characterized in that the end tabs forming the upper end wall (18) are bonded in a leak-proof manner to one another, with the exception of a region serving for opening the inner wrapping (13).

5. Pack according to claim 1, wherein said L-shaped bonding strip (45) has an extension, in the form of a transversely-directed leg (46), defining an opening region of the upper wall (18).

* * * * *